United States Patent [19]

Machacek et al.

[11] Patent Number: 4,718,954

[45] Date of Patent: Jan. 12, 1988

[54] EXPLOSIVE COMPOSITIONS

[75] Inventors: Oldrich Machacek, Dallas; Neil E. Gehrig, Richardson, both of Tex.; Gary R. Eck, Sarcoxie, Mo.

[73] Assignee: Thermex Energy Corporation, Dallas, Tex.

[21] Appl. No.: 844,459

[22] Filed: Mar. 26, 1986

[51] Int. Cl.[4] ..... C06B 31/28

[52] U.S. Cl. ..... 149/46; 149/60; 149/74; 149/83; 149/85; 149/88; 149/92; 102/313; 102/315

[58] Field of Search ..... 102/313, 315; 149/109.6, 44, 46, 60, 83, 92, 85, 88, 74

[56] References Cited

U.S. PATENT DOCUMENTS

| | | | |
|---|---|---|---|
| 4,207,125 | 6/1980 | Grant | 149/83 |
| 4,336,145 | 6/1982 | Briscoe | 149/108.8 |
| 4,388,254 | 6/1983 | Maes et al. | 149/109.6 |

*Primary Examiner*—Stephen J. Lechert, Jr.

*Attorney, Agent, or Firm*—Hubbard, Thurman Turner & Tucker

[57] ABSTRACT

An improved explosive composition and a method for making the composition are disclosed. The explosive composition is prepared by first formulating a gel concentrate that comprises a mixture of a sensitizer, such as hexamethylenetetramine or hexamethylenetetraminemononitrate and an oxidizer, such as ammonium nitrate in water and a gelling agent. Mixtures of sensitizers or mixtures of oxidizers can also be used in our invention. This gelled concentrate can be prepared, stored and later utilized to form the explosive composition by combining from 5 to 60 parts by weight of the gelled concentrate with from 95 to 40 parts by weight of a particulate oxidizer, such as ammonium nitrate or an ammonium nitrate-fuel oil composition. The resulting explosive compositions have increased densities and hence a significantly higher energy per unit volume. If desired, a cross-linking agent can be added to the combination of the gelled concentrate with the particulate oxidizer to improve the stability and water resistance of the thus formed explosive mixture. Other sensitizers can also be added to produce high explosive compositions.

8 Claims, No Drawings

EXPLOSIVE COMPOSITIONS

BACKGROUND OF THE INVENTION

This invention relates to improved explosive compositions. In another aspect, this invention relates to a method for making improved explosive compositions. In yet another aspect, this invention relates to the formation of relatively safe nonexplosive components that can be formulated, stored and shipped to various locations and then combined under field conditions to form an improved explosive composition. In still another aspect, this invention relates to improved explosive compositions and methods for making those compositions wherein such explosive compositions have a high bulk density and possess good stability properties. In yet another aspect, this invention relates to the production of improved explosive compositions that are produced from readily available and inexpensive components.

The use of explosive compositions is widespread in our industrial society. Indeed, vast amounts of explosive compositions are used in excavation work, mining work and the like.

Many different types of explosive compositions have been formulated for use in varying applications. Some of the best known explosives, such as dynamite, can be quite dangerous in their handling and storage. Such other explosives as ANFO (ammonium nitrate and fuel oil mixtures) and the like, while not as dangerous as dynamite, still pose problems in handling, storage and moisture resistance problems. Additionally, many of the well known and widely used explosive compositions are quite expensive. Due to cost considerations as well as safety considerations, there is a need for a safe and inexpensive explosive compositions.

In an effort to solve some of the problems associated with formulating and using explosive compositions, various alternative explosive compositions have been suggested in the prior art. For example, U.S. Pat. No. 3,713,918 disclosed explosive compositions that included paint grade aluminum in gels to produce an explosive composition. Additionally, U.S. Pat. No. 3,431,155 also suggested the use of gels wherein aluminum was mentioned as an auxiliary fuel. U.S. Pat. No. 3,962,001 and U.S. Pat. No. 3,409,486 also disclosed explosive compositions that included various gels and other components such as hexamethylenetetramine and aluminum as components thereof. Other disclosures such as are found in U.S. Pat. No. 3,676,236 and U.S. Pat. No. 3,947,301 are directed to explosive compositions that include various gels or slurries. The slurry compositions have been disclosed in various prior art such as U.S. Pat. No. 3,121,036, U.S. Pat. No. 3,658,607, U.S. Pat. No. 3,765,967 and U.S. Pat. No. 3,925,123. Blasting compositions made of emulsion and particulate oxidizers have also been disclosed in U.S. Pat. No. 4,111,727.

It is thus apparent that many different approaches have been suggested in the prior art for producing explosive compositions that can be formulated from readily available materials. However, all such prior suggestions in the art of forming explosive compositions have certain inherent properties such a problems associated with safe handling and storage of the explosive compositions. For example, many of the aforementioned prior art explosive compositions are plagued with problems such as instability of the explosives, especially when they are stored under field conditions over long periods of time as well as sensitivity to temperature, moisture and the like. Such prior art explosive compositions are also plagued with problems associated with the fact that they can be quite dangerous to store and handle since they can be accidently detonated or exploded once they are formulated and stored.

The inventors are well aware of the needs of the explosive industry and are well aware of many of the problems of prior art explosive compositions and have accordingly invented an improved type of explosive composition and method for formulating such improved explosive compositions.

SUMMARY OF THE INVENTION

It is therefore an object of this invention to provide improved explosive compositions that are formulated from readily available and inexpensive materials. It is also an object of this invention to provide an improved method for producing explosive compositions that have good explosive properties and performance levels. It is also an object of this invention to provide improved explosive compositions that can be field formulated from relatively safe and inexpensive precursors. It is yet another object of this invention to provide improved explosive compositions that have a high bulk density and good moisture resistance and stability properties.

It has now been discovered that improved explosive compositions can be produced from readily available and inexpensive materials in a safe and efficient manner by first formulating a "gel concentrate" and thereafter combining the gel concentrate with a particulate oxidizer material. The gel concentrate can be formulated and stored for long periods of time and can be combined with the particulate oxidizer under field conditions. In many instances the gel concentrate can be classified as a non-explosive thereby relaxing certain requirements associated with shipping and handling "explosives".

Broadly speaking, the compositions of our invention comprise: (a) 5 to 60 parts by weight of a gel concentrate that is made up of a sensitizer, an oxidizer and water with a gelling agent mixed therein and (b) from 95 to 40 parts by weight of a particulate oxidizer. The gel concentrate and the particulate oxidizer are combined and mixed in such a way that the gelled concentrate partially, but not completely, fills the interstitial voids between the particles of the oxidizer. Air voids can be formed in the final explosive composition by means of air bubbles trapped in the gel after mixing the gel concentrate with the particulate oxidizer.

The gel concentrate is nonexplosive and is relatively safe to handle, ship and store for relatively long periods of time. Likewise, the particulate oxidizer is relatively safe and can be handled, shipped and stored for long periods of time. Thus, the two main components of our invention can be mixed or field formulated near the location where the explosive compositions will be utilized to thereby avoid many of the problems and dangers normally associated with conventional explosives.

DESCRIPTION OF PREFERRED EMBODIMENT

The improved explosive compositions of this invention are made up of two main components. The first main component is a gel concentrate and the second main component is a particulate oxidizer. The two components are prepared separately and can be combined at the point of use to form the improved explosive compositions of this invention.

The gel concentrate is normally made up of a combination of a sensitizer, an oxidizer, water and a gelling agent. In the preferred embodiments of our invention, the gel concentrate is prepared by at least partially dissolving an oxidizer and a sensitizer in water with the addition of a gelling agent.

Suitable sensitizers include hexamethylenetetramine, hexamethylenetetraminemononitrate, hexamethylenetetraminedinitrate, methylaminenitrate, dimethylaminenitrate, ethylenediaminedinitrate, diethylenetriaminetrinitrate, triethylenetetraminetetranitrate, ammonium perchlorate monoethanolaminenitrate, diethanolaminedinitrate, ethyleneglycolmononitrate hexamethylenetetramineperchlorate, sodium perchlorate and the like.

Suitable oxidizers that can be utilized to prepare the gel concentrate of our invention include ammonium nitrate, sodium nitrate, sodium perchlorate, ammonium perchlorate, nitric acid, calcium nitrate and the like.

Suitable gelling agents, sometimes known as thickening agents, usually include a polysaccharide gum such as guar gum, modified guar gums such as hydroxy-propyl modified guar gums, gum arabic, starches, xanthan gum, polyacrylamides, various cellulose derivative materials such as carboxycellulose, methylcellulose, hydroxymethylcellulose, as well as synthetic polymeric thickening agents and the like.

In forming the gel concentrate of our invention, the sensitizer, oxidizer, water and gelling agent are combined in such amounts that the resulting gel concentrate normally has from about 10 to about 40 weight percent water. The normal amount of sensitizer will be from about 25 to about 40 weight percent of the resulting gel and the normal amount of the oxidizer will be from about 10 to 60 weight percent of the gel concentrate.

The preparation of the gel concentrate is carried out in conventional equipment by combining the ingredients and thoroughly mixing them in such a fashion as to at least partially dissolve the sensitizer and oxidizer in the water phase. In one preferred embodiment, the gel concentrate is formed by mixing the gelling agent with at least a portion of the oxidizer and at least a portion of the sensitizer to form a relatively homogeneous mixture of solid components with water being added thereafter while the complete mixture is agitated. Preferably, the agitation is continued until the solid components are dissolved and then the mixture is allowed to stand for a period of time sufficient to allow the gelling agent to thicken the solution to form a gel-like consistency. It has been found desirable to adjust the pH of the gel concentrate to a pH in the range of from about 4.5 to about 5.5 to prevent any undesired decomposition of the components of the gel concentrate. It has been found that in some instances, that if the pH of the gel concentrate becomes alkaline that ammonia may be released from the gel concentrate. Any compatible material such as a mineral acid can be used to adjust the pH of the gel. Nitric acid is especially useful as a pH adjuster.

It will of course be understood that various other methods of formulating the gel concentrate can also be utilized. For example, another preferred method of making the gel concentrate is to combine the oxidizer, and sensitizer with water to form a solution of the various components, adjust the pH and then add the gelling agent to form the gelled concentrate. Normally the gel concentrate will contain no undissolved solids. However in some instances, the gel concentrate may contain some undissolved components such that the gel concentrate may be in the form of a gelled slurry.

It has been found that the resulting gel concentrates are not particularly explosive in nature and are quite stable over long periods of time. In fact, it has been found that the gel concentrates of our invention have much longer shelf lives and are much more stable than conventional emulsions. Additionally, the gel concentrates of our invention do not have some of the undesired temperature stability problems that are normally encountered with other conventional explosives such as explosive emulsions.

Under normal practice, the gel concentrate will be formulated at a manufacturing site and can be stored in conventional containers and shipped, without the normal safety problems associated with explosive compositions and can be stored under a variety of conditions that conventional explosives cannot be stored under. It will be appreciated however, that in some instances with the proper selection of components the concentrate itself may be explosive in nature.

To form the explosive compositions of our invention, the gel concentrate is combined with a particulate oxidizer. The combination is carried out by using conventional mixing equipment such as tumblers, auger mixers, blenders, ribbon type mixers, paddle stir devices and the like. Conventional type concrete mixers can be easily used to produce the explosive compositions on a large scale. The explosive compositions are formed by combining from about 5 to 60 parts by weight of the gelled concentrate described above with from about 95 to 40 parts by weight of the particulate oxidizer material. The particulate oxidizer material can be any of the well known oxidizers such as ammonium nitrate, calcium nitrate, sodium nitrate, sodium perchlorate, ammonium perchlorate, mixtures thereof and the like. The mixing is carried out in such a fashion that the gel concentrate will at least partially coat the various particles of the oxidizer material with the resulting composition being one wherein the gel concentrate partially, but not completely fills the pores of the particulate oxidizer material.

In some instances it may be desirable to add additional fuel components such as carbonaceous materials to the resulting mixture of gel concentrate and oxidizer in order to improve the efficiency of the explosive composition. The addition of such carbonaceous materials is used to correct the "oxygen balance" of the composition. Suitable carbonaceous materials include fuel oil, ground coal, gilsonite, sugar, ethylene glycol, methanol and the like. If desired, such carbonaceous materials may be added to the gel concentrate.

If desired, a cross-linking agent can also be added to the combination of the gel concentrate and the particulate oxidizer to form a more stable explosive composition. The use of the cross-linker in many instances will make the resulting explosive composition more water resistant and will maintain the proper and desired amount of "aeration" in the explosive composition. "Aeration" as used herein means that there will be some unfilled spaces or voids between the various particles of the particulate oxidizer that are not filled with the gel concentrate. Maintaining such unfilled spaces, the explosive compositions are more easily detonatable.

Suitable cross-linking agents include water solutions of chromic acid, zirconium sulfate, aluminum sulfate and mixtures thereof. Other cross-linking systems include potassium pyroantimonate and various salts of polyvalent metals. It will be appreciated that such suitable cross-linking agents are well known in the art.

The particulate oxidizer material that is utilized in our invention can be any finely ground or prilled oxidizer. In many instances, it will be desirable to utilize a mixture of ammonium nitrate and fuel oil (ANFO) as the oxidizer component. ANFO is of course a well known and widely used blasting agent that is produced by blending or mixing ammonium nitrate particles with fuel oil or diesel fuel to produce a resulting admixture. Conventional ANFO comprises a mixture of approximately 94 weight percent ammonium nitrate and approximately 6 weight percent fuel oil or diesel fuel. While large quantities of ANFO are used as blasting agents it has several shortcomings such as low bulk density and very little resistance to water. The instant invention alleviates these disadvantages by using the gel concentrate to mix with ANFO to produce explosive compositions that have high water resistance and high bulk densities. Indeed, the instant invention is quite useful in vastly increasing the water resistance of ANFO.

The particle size of the oxidizer component of the explosive compositions of our invention is preferably no greater than an average particle diameter of number 6 U.S. Mesh.

The resulting explosive compositions of our invention that are formed from the combination of the gel concentrate and the particulate oxidizer can be free flowing particulate materials or can be rather rigid matrix structures, depending on the amount of cross-linking that takes place in the resulting mixture.

As used throughout this description of our invention, explosive compositions means a composition that can be detonatable by means of another explosive primer or explosive composition. While we do not wish to characterize our invention as the production of blasting agents only, it will be appreciated that some of our explosive compositions can be broadly classed as blasting agents. It will also be appreciated that by including larger amounts of sensitizers the explosive compositions of our invention can be made to detonate with conventional blasting caps.

In order to demonstrate our invention, the following examples are submitted herewith. It should be noted that the following examples are merely exemplary embodiments of our invention and that other types of blasting agents and explosive compositions can be formed using the broad disclosure herein set forth.

EXAMPLE 1

A gel concentrate was formed by mixing the following components:

| | Weight % |
|---|---|
| Water | 14.8 |
| Hexamethylenetetramine | 20.0 |
| Nitric Acid (57%) | 15.5 |
| Sodium Perchlorate (60%) | 12.5* |
| Ammonium Nitrate | 35.6 |
| T-4208 Guar Gum | 1.4 |
| T-4150 Guar Gum | 0.2 |

(The guar gum was manufactured by Celanese, Corp.)
*60% solution in water

The resulting gel contained no undissolved solids and was mixed with ANFO or prilled ammonium nitrate in a conventional drum-tumbler concrete mixer to form various test explosive compositions. The ANFO was prepared by coating 94 parts by weight industrial grade prilled ammonium nitrate with 6 parts by weight of diesel fuel. The prilled ammonium nitrate all passed through a number 6 U.S. Standard Mesh Screen. The various test explosive compositions are designated as 90/10 etc. which designations mean 90 parts by weight ANFO and 10 parts by weight gel concentrate etc. Charges of the test explosive compositions were prepared by placing them in cylindrical cardboard containers of approximately 20 inches long and with varying diameters as indicated. A one pound cast primer made of 50% PETN and 50% TNT was placed at one end of the cylinder to detonate the composition. Detonating cord was run to the primer to initiate the explosion in some instances. The detonating cord was initiated with an electric detonator. When the detonating cord was used, it was run inside the cylindrical container along one of the vertical walls of the cylinder to simulate actual field conditions where the charge was "precompressed" before the primer in the end of the cylinder was detonated. In those tests where detonating cord was used, the cord was a 25 grain detonating cord made by Ensign Bickford. When no detonating cord was used, the primer was initiated with an electric detonator. The test compositions were tested at 70° F. and 40° F. The test compositions were observed at detonation and an electronic counter was used to measure the unconfined detonation velocity in feet per second. Any detonation velocity below about 9000 feet per second is considered to be an indication of a poor explosive.

The following table shows the results of the foregoing tests (shown in parentheses are relative densities):

TABLE 1

| | Diameter of Test Cylinder | (Values reported in feet/second) 90 ANFO 10 gel | 80/20 | 70/30 | 60/40 | 60 AN/40 |
|---|---|---|---|---|---|---|
| Detonating Cord | 6"(70° F.) | 11390 (1.03) | 12380 (1.21) | 13400 (1.17) | 13320 (1.22) | 15240 (1.23) |
| Detonating Cord | 5"(70° F.) | 10800 (1.03) | Fail (1.18) | 13100 (1.18) | 12200 (1.26) | 14160 (1.21) |
| No Cord | 5"(70° F.) | 10550 (1.00) | 10200 (1.13) | 13260 (1.15) | 13190 (1.21) | 14285 (1.20) |
| No Cord | 4"(70° F.) | Fail (0.95) | Fail (1.14) | 11820 (1.15) | 12400 (1.20) | 13810 (1.20) |
| Detonating Cord | 6"(40° F.) | 11740 (0.99) | 9060 (1.18) | 11880 (1.17) | 11340 (1.23) | 11360 (1.22) |
| Detonating Cord | 5"(40° F.) | 9900 (1.03) | Fail (1.20) | 10820 (1.18) | Fail (1.31) | 12560 (1.29) |
| No Cord | 6"(40° F.) | 11710 (1.00) | 10920 (1.15) | 12500 (1.18) | 13020 (1.24) | 13660 (1.18) |

TABLE 1-continued

| | Diameter of Test Cylinder | (Values reported in feet/second) 90 ANFO 10 gel | 80/20 | 70/30 | 60/40 | 60 AN/40 |
|---|---|---|---|---|---|---|
| No Cord | 5" | 9430 (1.00) | Fail (1.14) | 11185 (1.18) | 11440 (1.22) | 13550 (1.17) |

EXAMPLE 2

A gel concentrate was formed by mixing the following components:

| | Weight % |
|---|---|
| Hexamethylenetetramine | 14.6 |
| Nitric Acid (57%) | 15.5 |
| Ammonium Nitrate | 35.8 |
| Sodium Perchlorate (60%) | 12.5 |
| T-4150 Guar Gum | 0.2 |
| T-4208 Guar Gum | 1.4 |

(The guar gum was manufactured by Celanese Corp.)

The above described concentrate was mixed with ANFO or ammonium nitrate prills using an auger mixer. Each mix was cross-linked with 1% by weight of a crosslinker based on the concentrate. The crosslinker was made up of 77% water, 6% chromic acid, 7% zirconium sulfate and 10% aluminium sulfate.

Explosive samples were formed as set out in Example 1 and detonating cord was used with each of the samples and were tested at between 42° and 46° F. The following are the test results with the detonating velocities reported in feet/second.

TABLE 2

| | | | | | | | |
|---|---|---|---|---|---|---|---|
| % Concentrate | 12 | 20 | 30 | 30 | 40 | 40 | — |
| % ANFO | 88 | 80 | 70 | — | 60 | — | 100 |
| % AN Prills | — | — | — | 70 | — | 60 | — |
| Sample Diameter: | | | | | | | |
| 4" | 9010 | Fail | Fail | | | | 8200 |
| 5" | 10870 | 10780 | | 11372 | 11468 | 11682 | 10000 |
| 6" | 11060 | 11040 | 11300 | 11876 | 11961 | 14327 | |
| 7½ | | | | 13123 | 14286 | 15151 | |
| Density (g/cm$^3$) | 1.02 | 1.18 | 1.18 | 1.18 | 1.20 | 1.20 | 0.90 |

EXAMPLE 3

Gel concentrates were formed by mixing the following components in weight percent:

| | GEL NUMBER 1 | 2 | 3 | 4 |
|---|---|---|---|---|
| Water | 8.9 | 9.5 | 8.8 | 15.2 |
| Hexamethylenetetramine | 15.0 | 17.0 | — | 20.0 |
| Nitric Acid (57%) | 20.0 | 18.5 | — | 15.5 |
| Monoethanolamine | 5.5 | 3.5 | — | — |
| Ammonium Nitrate | 25.2 | 26.1 | — | 35.8 |
| Sodium Perchlorate (63%) | 23.8 | 23.8 | 67.6 | 11.9 |
| Sugar | — | — | 22.0 | — |
| T-4150 Guar Gum | 0.2 | 0.2 | 0.2 | 0.2 |
| T-4208 Guar Gum | 1.4 | 1.4 | 1.4 | 1.4 |

(The guar gum was manufactured by Celanese Corp.)

The gel concentrates were mixed with ANFO in the ratio of 80% by weight ANFO and 20% by weight concentrate and loaded into cardboard cartridges of differing diameters. The test cartridges were detonated with cast primers only as explained in Example 1 and the detonation velocities are reported in feet per second (tests were at 70° F. and 40° F.):

TABLE 3

| Sample Diameter/Temp. | GEL NUMBER 1 | 2 | 3 | 4 |
|---|---|---|---|---|
| 3"(70° F.) | Fail | 7800 | 9300 | 10600 |
| 4"(70° F.) | 10400 | 11600 | 11600 | 11600 |
| 5"(70° F.) | 12800 | 12800 | 12500 | 1390 |
| 4"(40° F.) | 5400 | 5660 | 10960 | Detonation |
| 5"(40° F.) | 9160 | Fail | 11760 | 12500 |
| 6"(40° F.) | 11900 | 13500 | 13500 | 13900 |
| Density (g/cm$^3$) | 1.24 | 1.22 | 1.18 | 1.22 |

Gel number 3 was mixed with ANFO in a ratio of 85 parts ANFO and 15 parts gel and the following results were observed in feet per second:

| | |
|---|---|
| 3"(70° F.) | 10200 |
| 4"(70° F.) | 11600 |
| 5"(70° F.) | 12800 |
| 4"(40° F.) | 7700 |
| 5"(40° F.) | 11600 |
| 6"(40° F.) | 13200 |
| Density (g/cm$^3$) | 1.22 |

EXAMPLE 4

Gel concentrates were formed by mixing the following components in weight percent:

| | GEL NUMBER 1 | 2 | 3 |
|---|---|---|---|
| Water | 5.2 | 1.0 | 3.0 |
| Hexamethylenenitramine | 8.0 | — | 4.0 |
| Monoethanolamine | — | 8.8 | 4.4 |
| Nitric Acid (57%) | 6.2 | 16.0 | 11.1 |
| Ammonium Nitrate | 5.5 | 5.5 | 5.5 |
| Sodium Perchlorate (63%) | 6.7 | 6.7 | 6.7 |
| J-100 Guar Gum | 0.45 | 0.45 | 0.45 |
| T-4779 Guar Gum | 0.45 | 0.45 | 0.45 |
| DW-3 Crosslinker (Potassium Pyroantimonate) | 0.01 | 0.01 | 0.01 |

The concentrates were mixed with ammonium nitrate prills and the pH was adjusted to a pH of 5.2 to 5.8 and test samples were formed in accordance with Example 1. The following results in feet/second were observed when the samples were detonated with cast primer only:

TABLE 4

| Sample Diameter/Temp. | GEL NUMBER 1 | 2 | 3 |
|---|---|---|---|
| 4"(70° F.) | 12195 | 13158 | 11905 |
| 3"(70° F.) | 11364 | 12500 | 10638 |
| 2½"(70° F.) | 10204 | 10870 | 9804 |
| 5"(40° F.) | 12821 | 13158 | 11364 |
| 4"(40° F.) | 11628 | 12195 | 8929 |
| 3"(40° F.) | 10000 | 11110 | Fail |
| Density (g/cm$^3$) | 1.18 | 1.15 | 1.24 |

EXAMPLE 5

A gel concentrate was formed by mixing:

| | |
|---|---|
| Water | 30.5 |
| Ammonium Nitrate | 60.0 |
| Methanol | 9.0 |
| T-4779 Guar Gum | 0.5 |

The concentrate was mixed with ANFO in amounts of 90 parts ANFO to 10 parts concentrate and samples were formed in accordance with Example 1 and detonated without detonating cord. A 6 inch diameter sample had a detonating velocity of 10500 feet per second at 70° F. (Density of 1.00 g/cm$^3$). When the procedure was repeated at a mix of 85 parts ANFO and 15 parts gel concentrate the detonating velocity was 10300 feet per second. (Density 1.06 g/cm$^3$).

EXAMPLE 6

A gel concentrate was formed by mixing:

| | |
|---|---|
| Water | 39.3% |
| Ammonium Nitrate | 60.0% |
| T-4779 Guar Gum | 0.7% |

When the concentrate was mixed with ANFO and detonated at 70° F. in accordance with Example 1 without primer cord, the 90/10 mixture of ANFO to gel had observed detonating velocities of 10370 feet/second with a 6" diameter sample and 9380 feet/second with a 5" diameter sample. (Density 0.99 g/cm$^3$). When a mixture of 85/15 ANFO to gel was tested the 6" diameter sample had observed detonating velocities of 9900 feet/second and the 5" diameter sample had observed detonating velocities of 8930 feet/second. (Density 1.00 g/cm$^3$).

EXAMPLE 7

A gel concentrate was formed by mixing the following components in weight percent:

| | GEL NUMBER 1 | 2 |
|---|---|---|
| Water | — | 36.5 |
| Sodium Perchlorate (60%) | 28.4 | — |
| Ethleneglycol | 70.0 | — |
| Methylaminenitrate (100%) | — | 36.5 |
| Ammonium Nitrate | — | 25.8 |
| T-4150 Guar Gum (Celanese) | 1.4 | — |
| T-4120 Guar Gum (Celanese) | 0.2 | — |
| K1A112* Guar Gum | — | 1.2 |

*Manufactured by Kelco.

Concentrate Sample 1 was mixed with ammonium nitrate prills in the ratio of 80% ammonium nitrate, 20% concentrate and detonated with cast primers as explained in Example 1 at 70° F. Concentrate Sample 2 was mixed with ANFO in the ratio of 80% ANFO, 20% concentrate and detonated in the same way at 54° F. with reported values in feet of detonation/second:

TABLE 7

| Sample Diameter | GEL NUMBER 1 | 2 |
|---|---|---|
| 4" | 9100 | 7250 |
| 5" | 10650 | 10800 |
| 6" | 12300 | 10730 |
| Density (g/cm$^3$) | 1.18 | 1.19 |

We claim:

1. An improved explosive composition comprising an admixture of
   (a) from 5 to 60 parts by weight of a gelled concentrate formed by mixing a sensitizer, an oxidizer, water and a gelling agent and
   (b) from 95 to 40 parts by weight of a particulate oxidizer.

2. The explosive composition of claim 1 wherein a crosslinking agent is added to said admixture.

3. The explosive composition of claim 1 wherein said sensitizer is selected from the group consisting of hexamethylenetetramine, monomethylaminenitrate, dimethylaminenitrate, ethylenediaminedinitrate, diethylenetriaminetrinitrate, triethylenetetraaminetetranitrate, monoethanolaminenitrate, diethanolaminedinitrate, ethyleneglycolmononitrate, hexamethylenetetraminemononitrate, hexamethylenetetramineperchlorate, sodium perchlorate and hexamethylenetetramine dinitrate.

4. The explosive composition of claim 1 wherein said gelling agent is selected from the group consisting of a polysaccharide gum, a carboxymethylcellulose material and synthetic polymeric thickening agents.

5. The explosive composition of claim 1 wherein said gelled concentrate contains from about 10 to about 40 weight percent by water, from about 25 to 40 weight percent sensitizer and from about 10 to 60 weight percent oxidizer.

6. The explosive composition of claim 1 wherein said oxidizer is ammonium nitrate.

7. The explosive composition of claim 1 wherein said particulate oxidizer is ammonium nitrate-fuel oil.

8. The explosive composition of claim 1 wherein said particulate oxidizer is ammonium nitrate.

* * * * *